US010135176B1

(12) United States Patent
Lee

(10) Patent No.: US 10,135,176 B1
(45) Date of Patent: Nov. 20, 2018

(54) COAXIAL CABLE CONNECTOR

(71) Applicant: John Lee, Tainan (TW)

(72) Inventor: John Lee, Tainan (TW)

(73) Assignee: CHENG PU ELECTRIC CO., LTD., Tainan (TW)

( * ) Notice: Subject to any disclaimer, the term of this patent is extended or adjusted under 35 U.S.C. 154(b) by 0 days.

(21) Appl. No.: 15/934,695

(22) Filed: Mar. 23, 2018

(51) Int. Cl.

| | |
|---|---|
| ***H01R 9/05*** | (2006.01) |
| ***H01R 13/52*** | (2006.01) |
| ***H01R 13/6584*** | (2011.01) |
| ***H01R 13/627*** | (2006.01) |

(52) U.S. Cl.
CPC ..... *H01R 13/5205* (2013.01); *H01R 9/0521* (2013.01); *H01R 13/627* (2013.01); *H01R 13/6584* (2013.01)

(58) Field of Classification Search
CPC ..... H01R 17/12; H01R 9/0521; H01R 103/00
USPC ..... 439/578, 584, 583
See application file for complete search history.

(56) References Cited

U.S. PATENT DOCUMENTS

| | | | | |
|---|---|---|---|---|
| 7,241,172 | B2 * | 7/2007 | Rodrigues | H01R 9/0521 439/578 |
| 8,366,482 | B2 * | 2/2013 | Burris | H01R 9/0521 439/584 |
| 8,430,688 | B2 * | 4/2013 | Montena | H01R 24/564 439/578 |
| 8,449,326 | B2 * | 5/2013 | Holland | H01R 24/44 439/578 |
| 8,636,541 | B2 * | 1/2014 | Chastain | H01R 9/05 439/578 |
| 8,968,025 | B2 * | 3/2015 | Shaw | H01R 9/0521 439/578 |
| 2005/0233636 | A1 * | 10/2005 | Rodrigues | H01R 9/0521 439/578 |
| 2017/0255212 | A1 * | 9/2017 | Teggatz | G05F 1/10 |
| 2017/0358894 | A1 * | 12/2017 | Purdy | H01R 9/0524 |

* cited by examiner

*Primary Examiner* — Phuong Chi T Nguyen
(74) *Attorney, Agent, or Firm* — Che-Yang Chen; Law Offices of Scott Warmuth

(57) ABSTRACT

A coaxial cable connector comprises an assembly body, a cylindrical body and a fastening element. A portion of the fastening element is connected to a portion of one of the assembly body and cylindrical body, and when the fastening element is compressed during the process that the assembly body and the cylindrical body are relatively moving to a compression position, the portion of the fastening element is configured as a based portion where the fastening element bent from. Said configuration maximizes the inward deformation of the fastening element in the radial direction of the coaxial cable connector so as to provide much more fastening force to a coaxial cable installed therein and is adaptable to firmly fasten coaxial cables with various diameters. The waterproof effect is accordingly further enhanced as the fastening force.

8 Claims, 9 Drawing Sheets

COAXIAL CABLE CONNECTOR

BACKGROUND OF THE INVENTION

1. Field of the Invention

The present invention relates to a coaxial cable connector, particularly to a coaxial cable connector having a fastening element, which can provide enhanced fastening force and waterproof effect, and is configured to adaptable for coaxial cables with different cable diameters.

2. Description of the Prior Art

Coaxial cables and coaxial cable connectors are massively and widely used for transmitting radio frequency signals such as computer network connections, digital audio and television signals. U.S. Pat. No. 9,153,911B2 disclosed a conventional coaxial cable connector structure. Said conventional coaxial cable connector structure is simplified and redraw as shown in FIGS. 8 and 9. The coaxial cable connector comprises an assembly body, a cylindrical body 6000 and a clamping body 8000. The assembly body is used to be assembled by a central post 3000, a nut 4000 and a connector body 5000. Two distal ends of the clamping element 8000 are movably connected among the assembly body/connector body 5000 and the cylindrical body 6000. The main mechanism/technical feature for generating fastening force is realized by moving the cylindrical body 6000 to a compression position on the assembly body/connector body 5000 to exert force on the clamping element 8000, and therefor the clamping element 8000 is push/move inwardly to compress the coaxial cable 2000 therein (shown in FIG. 9).

However, the inward movement of the clamping element 8000 is short such that the corresponding fastening force may not sufficient to coaxial cables with smaller diameters. That is to say, under the convention configuration, connectors in different size-specifications are essential for installing coaxial cables in different diameters. When costumers/users buying/using coaxial cables or connectors, they have to notice about picking up a correct/matching specification for both of the coaxial cable and the connector; this may be common but actually cause inconvenient to costumers/users for a long time.

The present invention intends to provide a coaxial cable connector having a simpler configuration and adaptable for coaxial cables in different diameters.

SUMMARY OF THE INVENTION

One aspect of the present invention is to provide an improved coaxial cable connector to solve the abovementioned problems. In another aspect of the present invention, various configurations are provided to further enhance the fastening force among the elements of the coaxial cable connector and among the coaxial cable and the coaxial cable connector. In still another aspect of the present invention, waterproof effect is enhanced by some particular configurations described in this invention.

The present invention relates to a coaxial cable connector and comprises an assembly body, a cylindrical body and a fastening element. The cylindrical body defines a hollow space therethrough, and is movably connected to the assembly body in an extension position. The fastening element is arranged between the assembly body and the cylindrical body. When the assembly body and the cylindrical body are relatively moving to a compression position, the fastening element is bent inwardly. Wherein, a portion of the fastening element is connected to a portion of one of the assembly body and the cylindrical body, and when the fastening element is compressed during the process that the assembly body and the cylindrical body are relatively moving to the compression position, the portion of the fastening element is configured as a based portion where the fastening element bent from.

Under said configuration that when the assembly body and the cylindrical body are relatively moving to the compression position, the portion of the fastening element is configured as a based portion where the fastening element bent from, the inward deformation/bending of the fastening element in the radial direction of the coaxial cable connector is maximized so as to provide much more compressing/fastening/clamping force to a coaxial cable installed in and be adaptable to firmly fasten coaxial cables with various diameters. The waterproof effect is accordingly further enhanced as the fastening force.

Preferably, the assembly body is assembled by a central post, a nut and a connector body. The central post has a first connecting portion, and the connector body has a second connecting portion. One of the first connecting portion and the second connecting portion is a protrusion, and the other one is configured to receive the protrusion therein. Wherein, by the connecting configuration of the first and second connecting portions, the waterproof effect among the connection of the central post and the connector body is enhanced.

Preferably, the assembly body further comprises a first positioning portion, and the cylindrical body further comprises a second positioning portion. One of the first positioning portion and the second positioning portion is a protrusion, and the other one is configured to receive the protrusion therein. When the cylindrical body is moved to the compression position, the first and second positioning portions are connected to limit a relative movement among the assembly body and the cylindrical body. Under said configuration of the first and second positioning portions, the bending state of the fastening element and the fastening force generated therefrom are secured. Moreover, the fastening force is able to prevent from relative displacement and rotation between the coaxial cable and coaxial cable connector, so that the waterproof effect is further enhanced.

Preferably, the fastening element has at least one protrusion arranged on the inner side thereof. Said configuration of the at least one protrusion is adapt to generate more compressing force on the coaxial cable so as to further enhance the fastening force and waterproof effect between the fastening element and the coaxial cable.

Preferably, when the portion of the fastening element is connected to the portion of one of the assembly body and the cylindrical body, a guide portion is provided to the other one. The guide portion is configured to facilitate the fastening element to bend inwardly.

Preferably, the fastening element has an assistant guide portion for facilitating the fastening element to bend inwardly.

The objective, technologies, features and advantages of the present invention will become apparent from the following description in conjunction with the accompanying drawings wherein certain embodiments of the present invention are set forth by way of illustration and example.

BRIEF DESCRIPTION OF THE DRAWINGS

The foregoing conceptions and their accompanying advantages of this invention will become more readily appreciated after being better understood by referring to the following detailed description, in conjunction with the accompanying drawings, wherein.

DESCRIPTION OF THE PREFERRED EMBODIMENT

The detailed explanation of the present invention is described as follows. The described preferred embodiments and examples are presented for purposes of illustrations and description, and they are not intended to limit the scope of the present invention.

Figure 1:
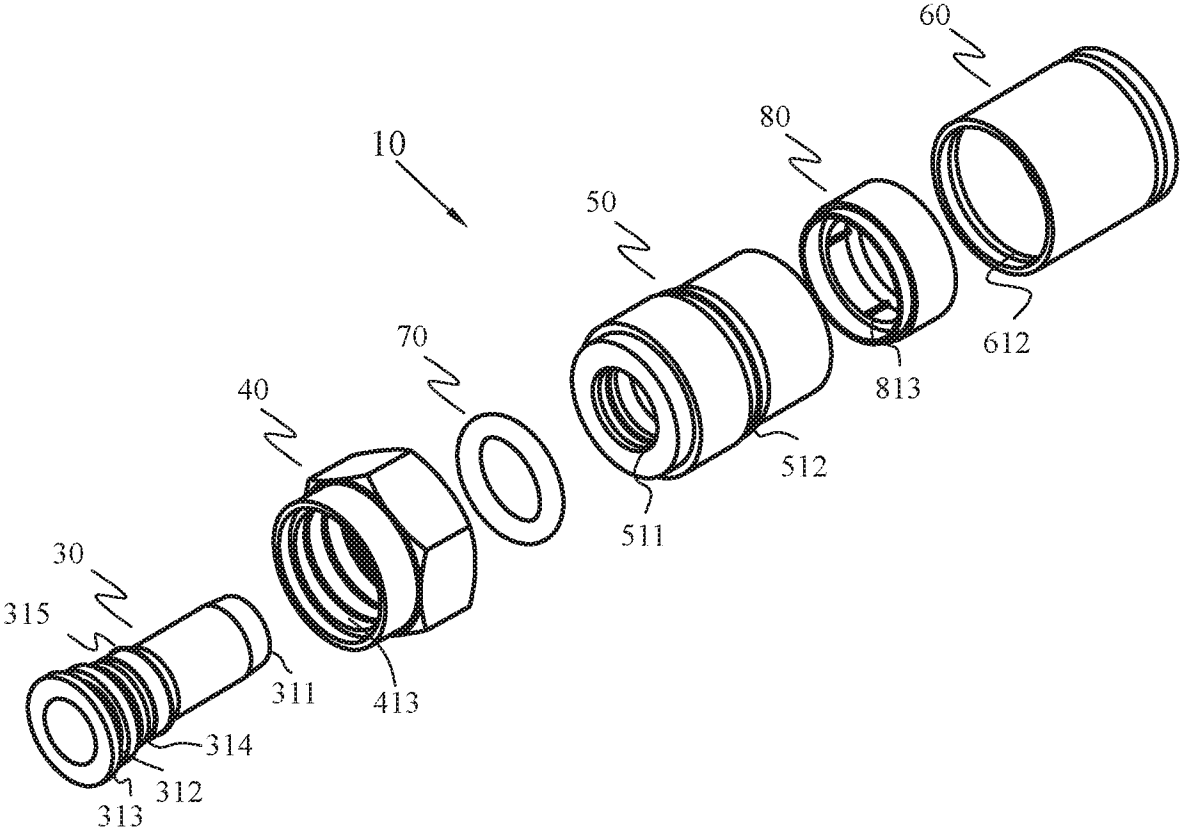
FIG. 1 is an exploded perspective view showing a connector of one embodiment of the present invention.
Figure 2:
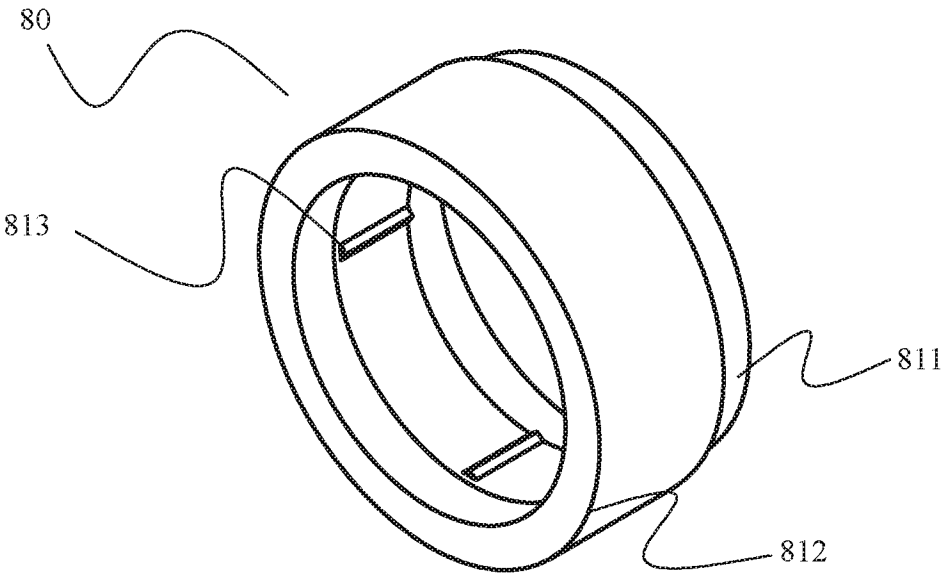
FIG. 2 is a perspective view of an exemplary embodiment of the fastening element.
Figure 3:
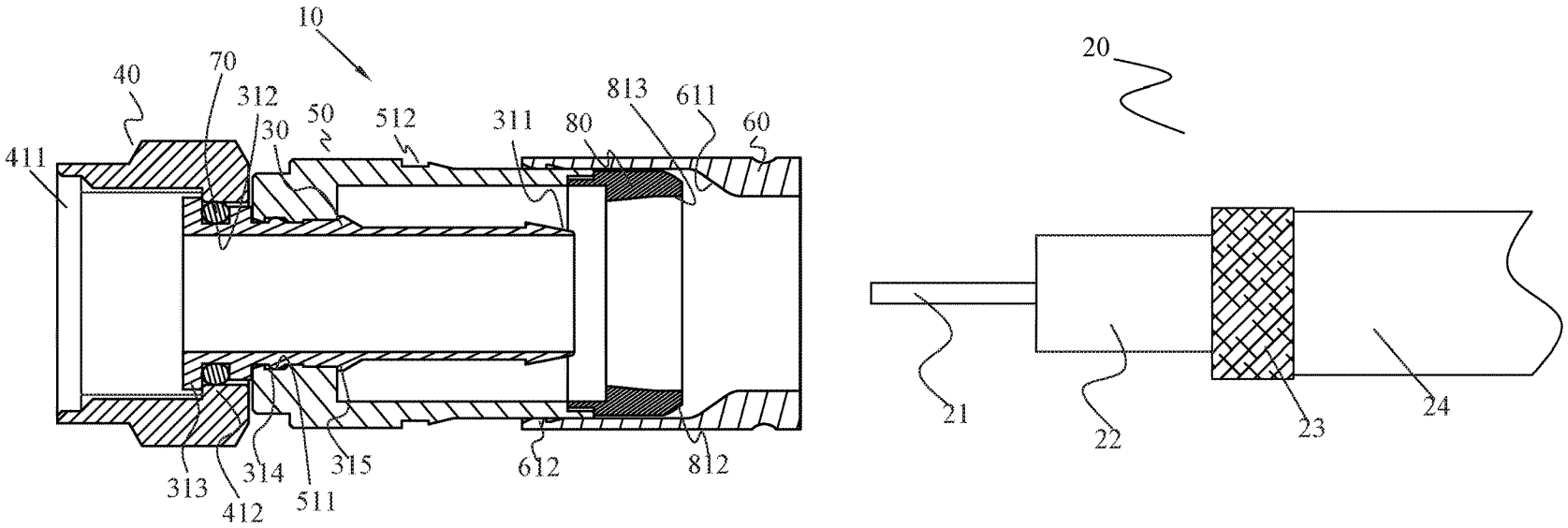
FIG. 3 shows a cross-sectional side view of the connector and a side view of a coaxial cable, wherein the cylindrical body is located at an extension position.

Referring to FIGS. 1 to 3 and 7, an embodiment of a connector for a coaxial cable is depicted. In FIG. 3, the coaxial cable 20 comprises a conductive copper core 21, an inner dielectric insulator 22, a net-shaped woven copper shield 23 and an outer plastic sheath 24. The inner dielectric insulator 22 is arranged outside the conductive copper core 21. The net-shaped woven copper shield 23, embracing the inner dielectric insulator 22, is covered by the outer plastic sheath 24. Before installing the coaxial cable 20 into the coaxial cable connector 10, the outer plastic sheath 24 should be removed firstly, so that the part of the net-shaped woven copper shield 23 is externally turned over to cover the outer surface of the outer plastic sheath 24.

In FIG. 1, the coaxial cable connector 10 comprises a central post 30, a nut 40, a connector body 50, a cylindrical body 60, a sealing ring 70 and a fastening element 80. The coaxial cable connector 10 is adapted to receive the coaxial cable 20 and to tightly hold the coaxial cable 20.

The central post 30 is a hollow column and comprises a penetrating portion 311, a groove 312, a flange 313, a first connecting portion 314 and a wedge portion 315. Wherein, the sealing ring 70, made of a compressible material, can be properly arranged in the groove 312 of the central post 30.

The nut 40 comprises an inner protruding part 412 and a thread portion 413. Wherein, the thread portion 413 is adapted to connect to a corresponding element or device.

The connector body 50 defines a hollow space therethrough, and comprises a second connecting portion 511 and a first positioning portion 512. Wherein, the second connecting portion 511, arranged at the inner side of the connector body 50, is configured to correspondingly connect to the first connecting portion 314. The first positioning portion 512 is arranged at the outer side of the connector body 50.

The central post 30, the nut 40 and the connector body 50 are used to be assembled together to form an assembly body (as shown in FIG. 3). When assembling, the central post 30 is inserted in the nut 40, and the flange 313 is connected to the inner protruding part 412. Then, the connector body 50 is installed to the central post 30. Wherein, in such assembly state, the wedge portion 315 will limit a movement of the connector body 50, and the nut 40 is limited among the flange 313 of the central post 30 and the connector body 50. Moreover, the nut 40 covers and compresses the sealing ring 70 in the groove 312 so as to enhance the waterproof effect. Further, the first connecting portion 314 is connected to the second connecting portion 511. The connection among the first connecting portion 314 and the second connecting portion 511 is close-fit so as to provide remarkable waterproof effect. In a preferred example, the first connecting portion 314 is a ring-shape protrusion, and the second connecting portion 511 is a groove corresponding thereto.

The cylindrical body 60 defines a hollow space therethrough, and comprises a guide portion 611 and a second positioning portion 612. Wherein, the second positioning portion 612 is configured to correspondingly connect to the first positioning portion 512. When the cylindrical body 60 is located at a first position/an extension position (shown in FIG. 3), the cylindrical body 60 is movably connected to the connector body 50. When the cylindrical body 60 is moved to a second/compression position (shown in FIG. 6), the second positioning portion 612 is connected to the first positioning portion 512, so that the cylindrical body 60 is rotationally fixed to the connector body 50. The connection among the second positioning portion 612 and the first positioning portion 512 is close-fit so as to prevent relative displacement or rotation among the cylindrical body 60 and connector body 50, and hence enhance the waterproof effect thereamong. In a preferred example, the first positioning portion 512 is a concave portion, and the second positioning portion 612 is a convex portion corresponding thereto.

The fastening element 80 is arranged between the connector body 50 and the cylindrical body 60. In one embodiment of this invention (shown in FIG. 3), a portion of the fastening element 80 is connected to a portion of one of the connector body 50. When the cylindrical body 60 is moved to the compression position (shown in FIG. 6), the guide portion 611 facilitates the fastening element 80 to bend inwardly. In a preferred embodiment, the guide portion 611 is an inclined surface so as to inwardly bend the fastening element 80 smoothly. In a further embodiment, corresponding to the guide portion 611, the fastening element 80 has an assistant guide portion 812 (shown in FIGS. 4 and 5), such as an inclined surface, so as to smooth the formation of inwardly bending feature.

Figure 4:
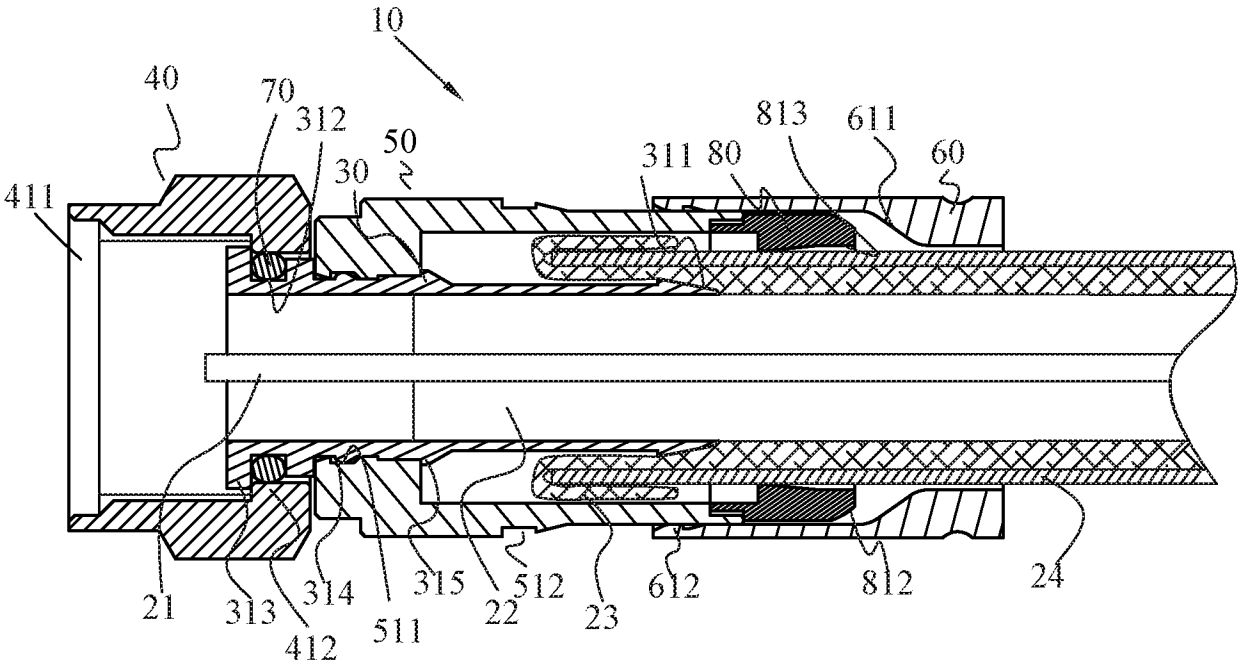
FIG. 4 is a cross-sectional side view, according to FIG. 3, showing that the coaxial cable is inserted in the connector.
Figure 5:
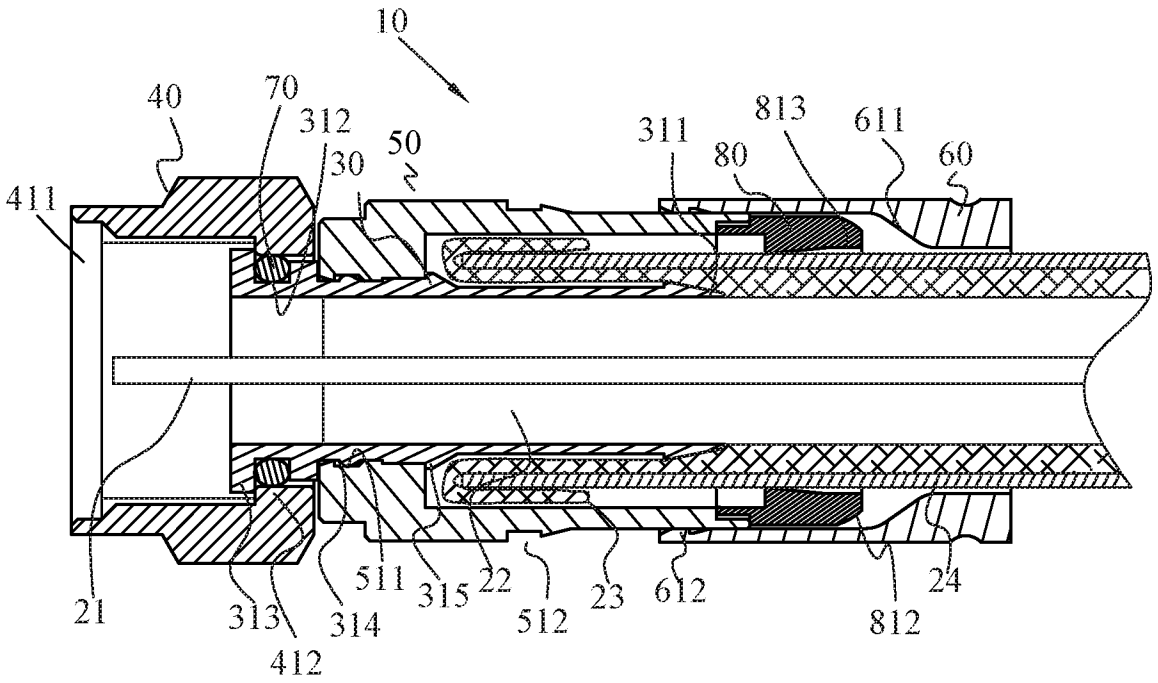
FIG. 5 is a cross-sectional side view, according to FIG. 4, showing that the coaxial cable is further inserted in the connector to an adequate position.
Figure 6:
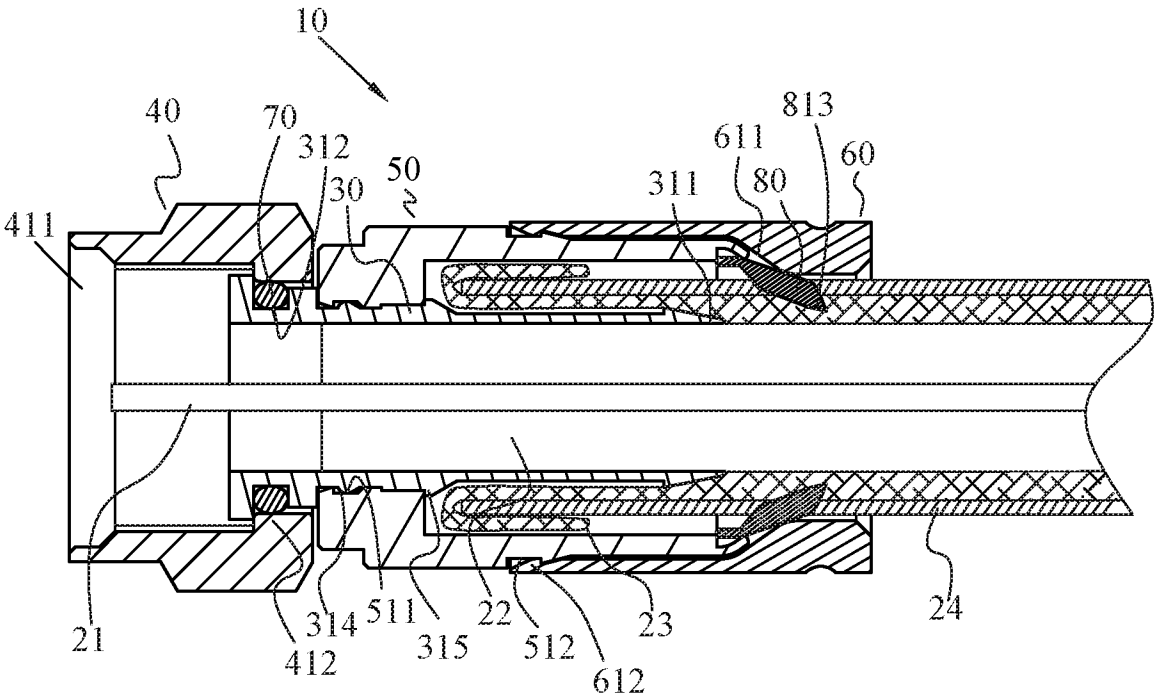
FIG. 6 is a cross-sectional side view, according to FIG. 5, showing that the cylindrical body is located at a compression position such that the fastening element is deformed inwardly to firmly fix the coaxial cable.
Figure 7:
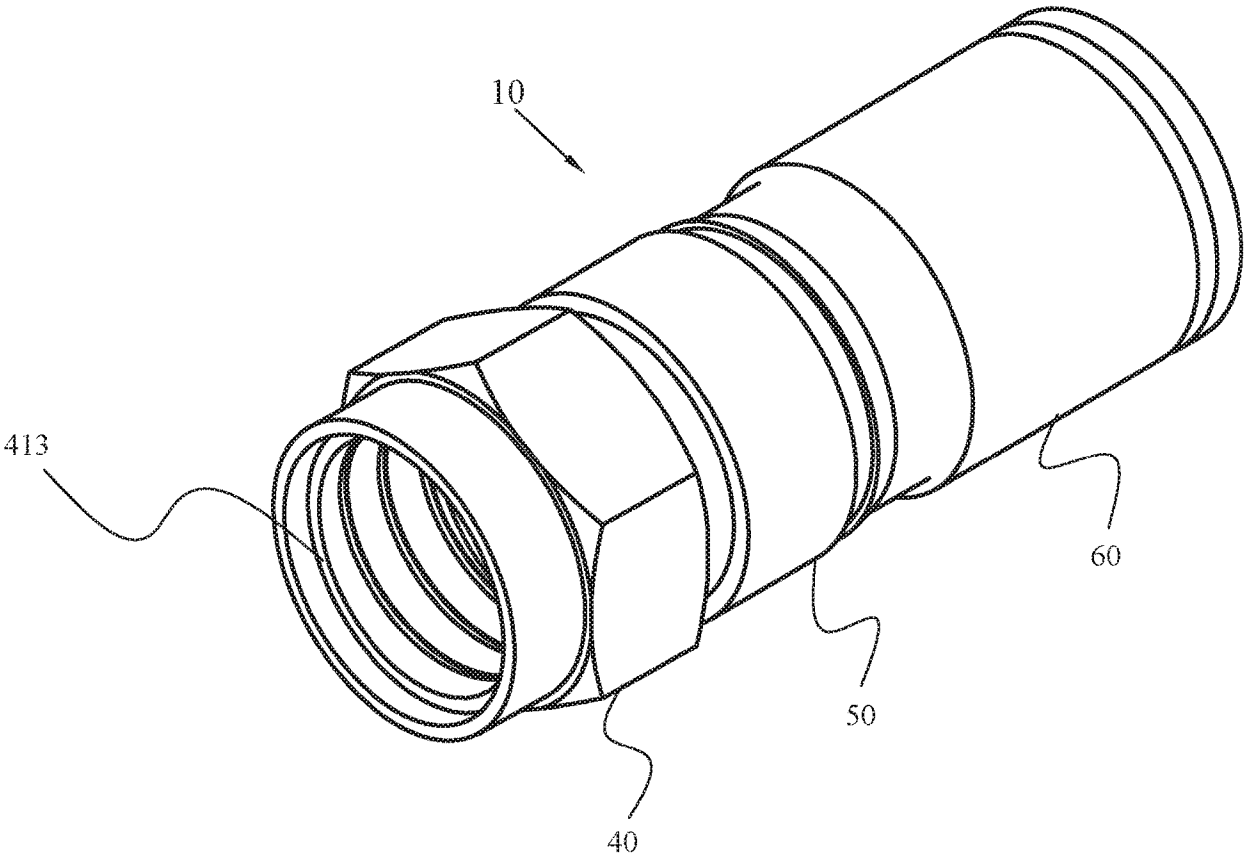
FIG. 7 is a perspective view, according to FIG. 6, showing the connector of the present invention without the coaxial cable therein.
Figure 8:
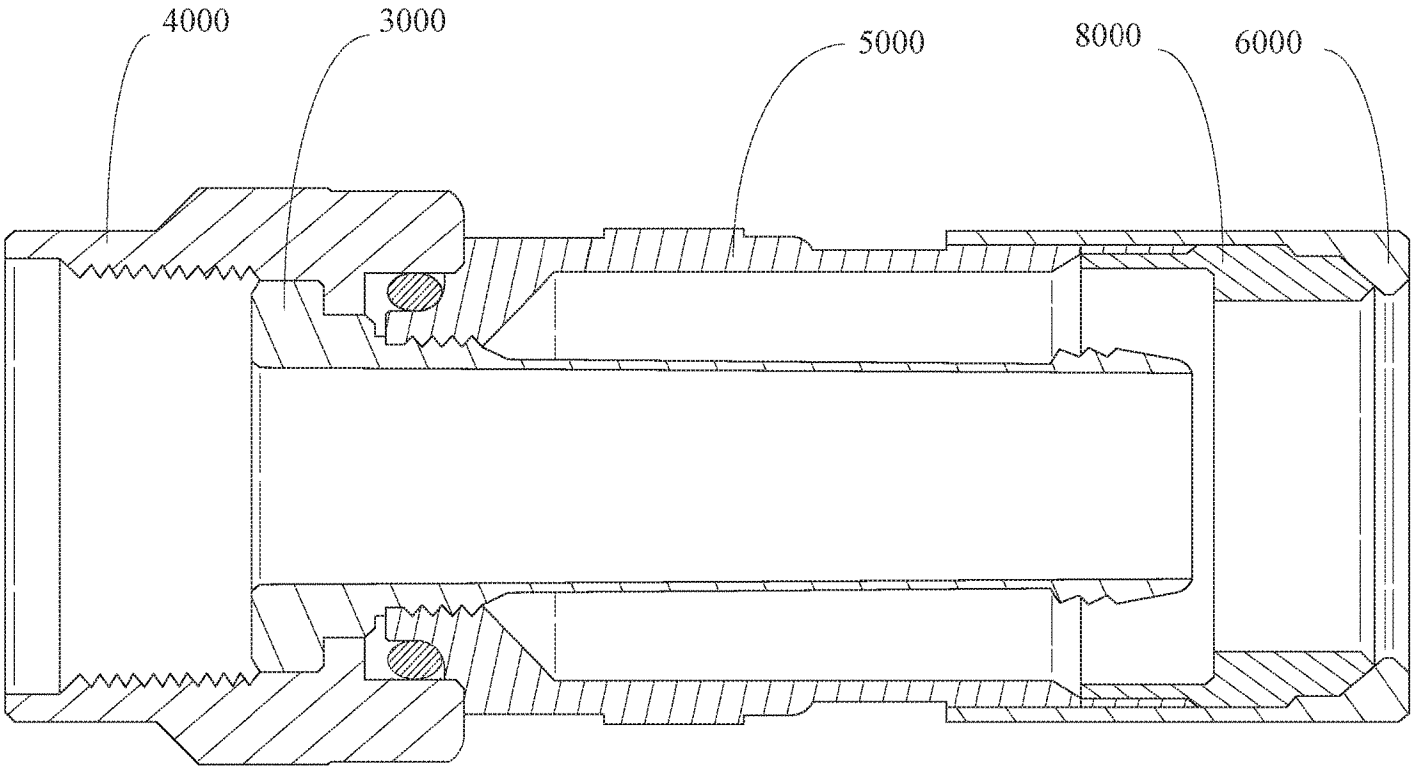
FIG. 8 PRIOR ART
FIG. 8 is a cross-sectional side view of a conventional coaxial cable connector.
Figure 9:
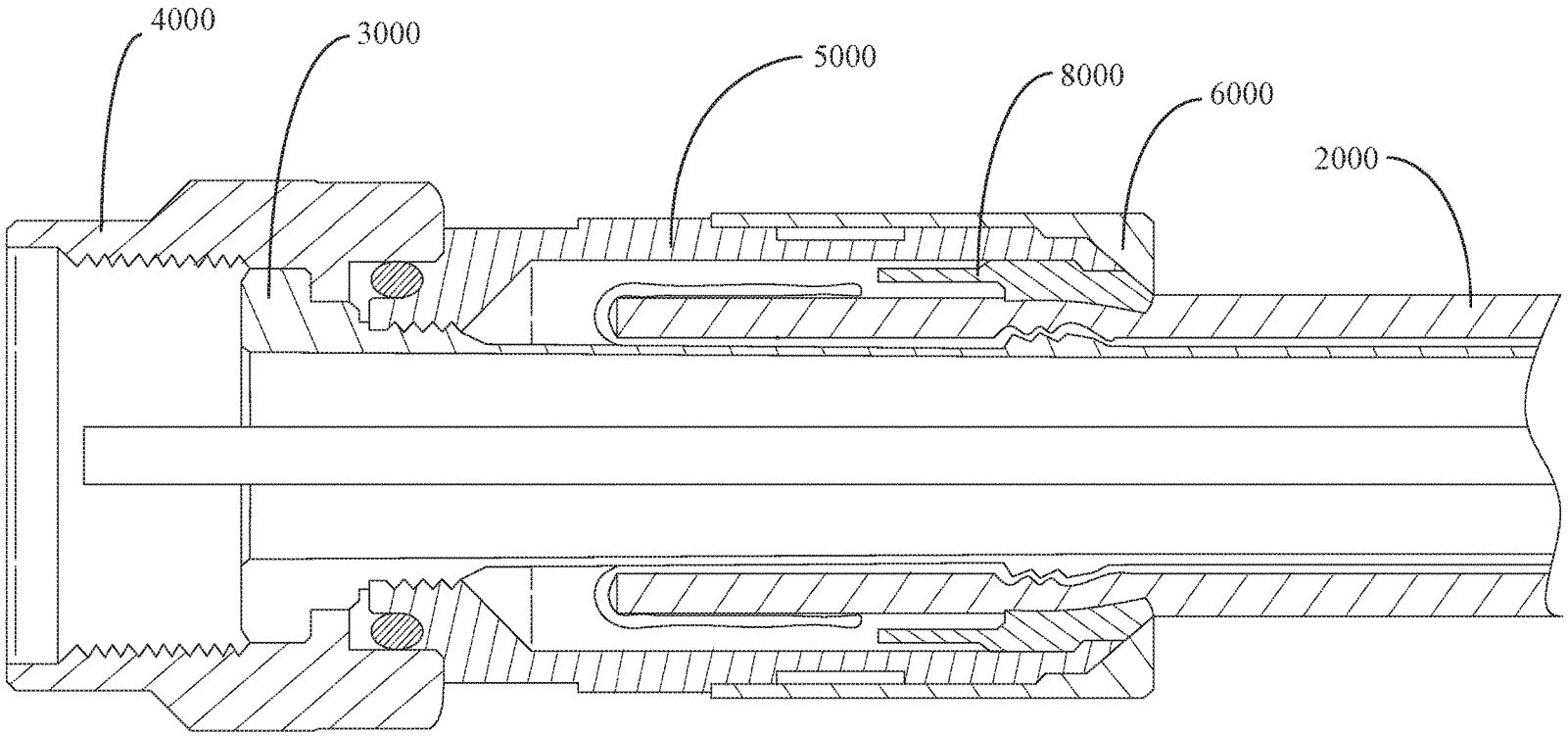
FIG. 9 PRIOR ART
FIG. 9 shows a cross-sectional side view of the conventional coaxial cable connector, wherein the cylindrical body is moved to a compression position, and the overall clamping element is moved inwardly to fasten the coaxial cable therein.

FIGS. 4 to 6 show one embodiment of this invention that how the fastening element 80 enhances the fastening force among the coaxial cable 20 and the coaxial cable connector 10. Firstly, as shown in FIG. 4, the coaxial cable 20 is initially inserted into the coaxial cable connector 10. Wherein, the penetrating portion 311 is inserted into the coaxial cable 20 and located among the inner dielectric insulator 22 and the net-shaped woven copper shield 23. In a preferred embodiment, the penetrating portion 311 forms a tapering shape so as to facilitate the insertion thereof into the coaxial cable 20.

Secondly, as shown in FIG. 5, the coaxial cable 20 is further inserted to an adequate position where the penetrating portion 311 is inserted deeper into the coaxial cable 20 and hence to generate more securing/fastening force therebetween.

Finally, as shown in FIG. 6, the fastening element 80 is bent inwardly, while moving the cylindrical body 60 to the compression position, so that the fastening element 80 is inserted into or firmly compresses the coaxial cable 20 to generate remarkable fastening force. More specifically, when the fastening element 80 is compressed during the process that the connector body 50 and the cylindrical body 60 are relatively moving to the compression position, the portion of the fastening element 80 become a based portion where the fastening element 80 bent from. In the preferred embodiment of this invention as the schematic diagrams shown, the fastening element 80 forms as a hollow-cylinder shape. In other alternative embodiments (not shown), the fastening element 80 could be formed by single column or a plurality of columns.

Wherein, in the compression position, the connection among the first positioning portion 512 and the second positioning portion 612 limits a relative movement among the connector body 50 and the cylindrical body 60, so that the bending state of the fastening element 80 and the fastening force generated therefrom are secured. Moreover, the fastening force is able to prevent from relative displacement and rotation between the coaxial cable 20 and coaxial cable connector 10, so that the waterproof effect is further enhanced.

Especially, the configuration, the portion of the fastening element 80 connected to the portion of the connector body 50 become a based portion where the fastening element 80 bent from, maximizes the inward deformation/bending of the fastening element 80 in the radial direction of the coaxial cable connector 10 so as to provide much more compressing/fastening/clamping force to the coaxial cable 20. That is to say, under said configuration, a maximum fastening force is achieved. Further, said configuration, maximizing the inward deformation/bending of the fastening element 80, also means a much deeper depth that the deformed fastening element 80 is extended inwardly, so that coaxial cables with a smaller diameter can still be fixed firmly. More specifically, said configuration of this invention is adapted to coaxial cables with different specifications. In one preferred example, said configuration, configured in one suitable size-specification, is adapted to firmly fix any one of the coaxial cables made with two, three and four shield layers.

Referring to FIG. 2, in a preferred embodiment, at least one protrusion 813 is arranged on the inner side of the fastening element 80. In the schematic diagrams of this invention, the shape of the protrusion 813 is drawn as a protruding rib, and there are at least two protrusions 813. Wherein, when the cylindrical body 60 is located at the compression position (shown in FIG. 6), the protrusion 813 generates more compressing force on the coaxial cable 20 so as to further enhance the fastening force and waterproof effect between the fastening element 80 and the coaxial cable 20. In a preferred embodiment, the protrusion 813 is configured to insert into the outer plastic sheath 24 such that said fastening force and waterproof effect are further enhanced.

It should be noted that the configuration of said "based portion" may be deemed as a fixed point where the fastening element 80 bent from. That is to say, during the bending deformation of the fastening element 80, the connection(s) among the fastening element 80 and the connector body 50 can be deemed as a fixed connection. More precisely, observing the whole deformation of the fastening element 80 in a smaller scale, the precise position of said fixed point of the connection among the fastening element 80 and the connector body 50 may be varied at different timing of the deforming process. Moreover, the connection among the fastening element 80 and the connector body 50 may include the motion of rotation, displacement or slide. Wherein, the abovementioned modes/types/patterns of the connection of the fastening element 80 and the connector body 50 are included in the claimed scope of the invention by the claimed feature "a portion of the fastening element is connected to a portion of one of the assembly body and the cylindrical body, and when the fastening element is compressed during the process that the assembly body and the cylindrical body are relatively moving to the compression position, the portion of the fastening element is configured as a based portion where the fastening element bent from". In one preferred example of the invention (shown in FIGS. 5 and 6), a distal end portion of the fastening element 80 is connected to a distal end portion of the connector body 50; wherein said distal ends of the fastening element 80 and connector body 50 is configured to form said configuration of said "based portion". In some other embodiments (not shown), various modifications can be made to accomplish said configuration of said "based portion". Still, in some embodiments (not shown), said configuration of said "based portion" can be achieved by making that a portion of the fastening element 80 is fixedly connected to a portion of the connector body 50.

It should be noted that although said assembly body of this invention is formed by the central post 30, the nut 40, the connector body 50 and other detailed features thereof, there are various structures or mechanisms which have been disclosed in the prior arts. Hence, when the claimed invention used the term "assembly body", the claimed scope of the "assembly body" is not limited to the particular form disclosed in this invention. While the invention is susceptible to various modifications and alternative forms, a specific example thereof has been shown in the drawings and is herein described in detail.

It should be noted that the schematic diagrams of this invention just show one of possible/feasible arrangements among the connector body 50/assembly body, the cylindrical body 60 and the fastening element 80. In other words, under said fastening mechanism for generating remarkable fastening force by said elements 50 (or assembly body), 60 and 80, other feasible modifications are included in the scope of this invention. More specifically, the merit of this invention is achieved by making the fastening element 80 deform/turn/bend inwardly, caused by acting/compressing forces applied by the connector body 50/assembly body and the cylindrical body 60, to generate further fastening force on the coaxial cable 20, when the connector body 50/assembly body and the cylindrical body 60 are relatively moving to a specific position/said compression position. Wherein, the configuration that the portion of the fastening element 80 connected to the portion of the connector body 50/assembly body is configured as a based portion where the fastening element 80 bent from maximizes the inward deformation/bending of the fastening element 80 so as to provide further enhance fastening force. In a preferred embodiment, two corresponding features, such as features 512 and 612, are respectively set on connector body 50/assembly body and the cylindrical body 60, and fixed to each other in the specific compression position.

It should be noted that, in alternative embodiments, those corresponding features of the corresponding elements are interchangeable. In one alternative embodiment (not shown), the connection among a portion of the fastening element 80 and a portion of the connector body 50 can be modified to that a portion of the fastening element 80 is connected to a portion of the cylindrical body 60. Further, if the portion of the fastening element 80 is connected to the portion of the cylindrical body 60, then the corresponding feature, the first guide portion 611 should be modified to set on the connector body 50/assembly body. In other examples (not shown), those so-called concave/groove and convex/protrusion features are interchangeable; for example, people having ordinary knowledge in the art can easily modify the two corresponding features 314 and 511 to be a concave feature and a convex feature respectively. That is to say, although the claimed invention may define such corresponding features in specific constructions/configurations, such specific constructions are not to limit the scope of this invention as the corresponding alternative modifications are so obviously to be made.

It should be understood, however, that the invention is not to be limited to the particular form disclosed, but to the contrary, the invention is to cover all modifications, equivalents, and alternatives falling within the spirit and scope of the appended claims.

What is claimed is:

1. A coaxial cable connector comprising:

an assembly body;

a cylindrical body which defines a hollow space therethrough, the cylindrical body is movably connected to the assembly body in an extension position; and a fastening element which is arranged between the assembly body and the cylindrical body; the fastening element is bent inwardly, when the assembly body and the cylindrical body are relatively moving to a compression position;

wherein a portion of the fastening element is connected to a portion of one of the assembly body and the cylindrical body, and when the fastening element is compressed during the process that the assembly body and the cylindrical body are relatively moving to the compression position, the portion of the fastening element is configured as a based portion where the fastening element to be piecing into the cable;

wherein the assembly body comprises a central post which is a hollow column and comprises a flange, a first connecting portion and a wedge portion; a nut which comprises an inner protruding part; and a connector body which defines a hollow space therethrough, and comprises a second connecting portion;

wherein the central post is inserted in the nut, the flange is connected to the inner protruding part, the connector body is installed to the central post, the wedge portion is configured to limit a movement of the connector body, the nut is limited among the flange and the connector body; and wherein one of the first connecting portion and the second connecting portion is a protrusion, and the other one is configured to receive the protrusion therein;

wherein the fastening element has at least one protrusion arranged on the inner side thereof;

wherein the fastening element has an assistant guide portion for facilitating the fastening element to bend inwardly.

2. The coaxial cable connector according to claim 1, further comprising a coaxial cable inserted therein; when the assembly body and the cylindrical body are relatively moving to a compression position, the fastening element is bent inwardly to insert into or firmly compress the coaxial cable.

3. The coaxial cable connector according to claim 1, wherein when the portion of the fastening element is connected to the portion of one of the assembly body and the cylindrical body, a guide portion is provided to the other one; when the assembly body and the cylindrical body are relatively moving to the compression position, the guide portion is configured to facilitate the fastening element to bend inwardly.

4. The coaxial cable connector according to claim 3, further comprising a coaxial cable inserted therein; when the assembly body and the cylindrical body are relatively moving to a compression position, the fastening element is bent inwardly to insert into or firmly compress the coaxial cable.

5. The coaxial cable connector according to claim 1, wherein the assembly body further comprises a first positioning portion, the cylindrical body further comprises a second positioning portion; one of the first positioning portion and the second positioning portion is a protrusion, and the other one is configured to receive the protrusion therein; when the cylindrical body is moved to the compression position, the first and second positioning portions are connected to limit a relative movement among the assembly body and the cylindrical body.

6. The coaxial cable connector according to claim 5, further comprising a coaxial cable inserted therein; when the assembly body and the cylindrical body are relatively moving to a compression position, the fastening element is bent inwardly to insert into or firmly compress the coaxial cable.

7. The coaxial cable connector according to claim 5, wherein when the portion of the fastening element is connected to the portion of one of the assembly body and the cylindrical body, a guide portion is provided to the other one; when the assembly body and the cylindrical body are relatively moving to the compression position, the guide portion is configured to facilitate the fastening element to bend inwardly.

8. The coaxial cable connector according to claim 7, further comprising a coaxial cable inserted therein; when the assembly body and the cylindrical body are relatively moving to a compression position, the fastening element is bent inwardly to insert into or firmly compress the coaxial cable.

* * * * *